US010480433B2

(12) United States Patent
Won et al.

(10) Patent No.: US 10,480,433 B2
(45) Date of Patent: Nov. 19, 2019

(54) APPARATUS AND METHOD FOR CALCULATING INTERNAL EXHAUST GAS RECIRCULATION (EGR) AMOUNT OF ENGINE INCLUDING CONTINUOUSLY VARIABLE VALVE DURATION APPARATUS

(71) Applicants: Hyundai Motor Company, Seoul (KR); Kia Motors Corporation, Seoul (KR)

(72) Inventors: Min-Kyu Won, Gyeonggi-do (KR); Hyung-Soo Do, Gyeonggi-do (KR); Soo-Hyeok Kang, Gyeonggi-do (KR); Dae-Woo Kim, Gyeonggi-do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 72 days.

(21) Appl. No.: 15/838,862

(22) Filed: Dec. 12, 2017

(65) Prior Publication Data

US 2019/0085777 A1 Mar. 21, 2019

(30) Foreign Application Priority Data

Sep. 18, 2017 (KR) ..... 10-2017-0119417

(51) Int. Cl.

| | |
|---|---|
| ***F02D 13/00*** | (2006.01) |
| ***F02D 41/00*** | (2006.01) |
| ***F02D 13/02*** | (2006.01) |
| *F02D 41/14* | (2006.01) |

(52) U.S. Cl.

CPC ..... *F02D 41/0052* (2013.01); *F02D 13/0207* (2013.01); *F02D 13/0215* (2013.01); *F02D 13/0261* (2013.01); *F02D 41/0062* (2013.01); *F02D 41/0077* (2013.01); *F02D 41/1446* (2013.01); *F02D 41/1448* (2013.01); *F02D 2200/0406* (2013.01)

(58) Field of Classification Search

CPC ..... F02D 41/0052; F02D 41/0062; F02D 41/0077; F02D 41/1448; F02D 41/1446; F02D 13/0207; F02D 13/0215; F02D 13/0261; F02D 2200/0406

USPC ..... 123/568.14, 90.15; 701/108; 73/114.74

See application file for complete search history.

(56) References Cited

U.S. PATENT DOCUMENTS

| | | | | |
|---|---|---|---|---|
| 7,367,318 | B2 * | 5/2008 | Moriya | F02D 13/0203 123/435 |
| 7,685,980 | B2 * | 3/2010 | Lee | F01L 13/0021 123/90.15 |
| 9,341,135 | B2 * | 5/2016 | Watanuki | F02D 43/00 |
| 9,399,459 | B2 * | 7/2016 | Glugla | B60W 10/06 |
| 9,897,035 | B2 * | 2/2018 | Yokoi | F02D 41/0062 |

(Continued)

FOREIGN PATENT DOCUMENTS

| | | |
|---|---|---|
| KR | 10-0412592 | 12/2003 |
| KR | 10-2013-0063819 A | 6/2013 |

*Primary Examiner* — Hai H Huynh

(74) *Attorney, Agent, or Firm* — Mintz Levin Cohn Ferris Glovsky and Popeo, P.C.; Peter F. Corless

(57) ABSTRACT

A method and apparatus for calculating an internal exhaust gas recirculation (EGR) amount of an engine include a continuously variable valve duration (CVVD) apparatus. The internal EGR amount is calculated by correcting a backflow gas amount based on a valve duration changed by operation of the continuously variable valve duration apparatus during valve overlap of an intake valve or an exhaust valve.

17 Claims, 10 Drawing Sheets

(56) References Cited

U.S. PATENT DOCUMENTS

| | | | | |
|---|---|---|---|---|
| 10,047,684 | B2 * | 8/2018 | Ryu | F02D 13/0215 |
| 2014/0172278 | A1 * | 6/2014 | Kosaka | F02D 41/0062 701/108 |

* cited by examiner

APPARATUS AND METHOD FOR CALCULATING INTERNAL EXHAUST GAS RECIRCULATION (EGR) AMOUNT OF ENGINE INCLUDING CONTINUOUSLY VARIABLE VALVE DURATION APPARATUS

CROSS-REFERENCE(S) TO RELATED APPLICATION

This application claims under 35 U.S.C. § 119(a) the benefit of Korean Patent Application No. 10-2017-0119417, filed on Sep. 18, 2017, the entire contents of which are incorporated herein by reference.

BACKGROUND

(a) Technical Field

Exemplary embodiments of the present disclosure relate to an apparatus and method for calculating an internal exhaust gas recirculation (EGR) amount of an engine including a continuously variable duration apparatus, and more particularly, to an apparatus and method for calculating an internal EGR amount of an engine by reflecting a changed valve profile when a valve profile is changed by operation of a continuously variable duration apparatus.

(b) Description of Related Art

Accurately calculating an amount of intake air of an engine of a vehicle is an essential condition to improve performance of the engine and fuel efficiency. Further, it is also a key element for determining components of exhaust gas. In particular, in a gasoline engine, fuel is injected so that a theoretical air-fuel ratio is controlled based on the amount of intake air of the engine, thus it is important to accurately calculate the amount of intake air of the engine. If the calculated amount of intake air of the engine is larger than an actual value, then excessive fuel is injected, such that problems such as deterioration of fuel efficiency and emission of harmful gas (CO and HC) may occur. Further, on the contrary, if the calculated amount of intake air of the engine is smaller than the actual value, a relatively smaller amount of fuel is injected, such that problems such as deterioration of output performance of the engine and emission of harmful gas (NOx) may occur.

Meanwhile, in order to accurately calculate the amount of intake air of the engine, an amount of internal EGR generated during valve overlap must be accurately calculated. This is because air used for combustion is fresh air introduced through an intake value, and a charge amount of the fresh air may vary according to an amount of combusted gas in a cylinder.

FIGS. 7 and 8 are diagrams illustrating a structure of an intake system including a cylinder 40, valves 20 and 30, and the like of the engine. The intake air is collected in a surge tank by passing through a throttle valve 10, and introduced into the cylinder 40 while an intake value 20 is opened. At this time, a flow rate of the intake air is calculated using an internal pressure of the cylinder calculated using a pressure of the surge tank and an exhaust pressure measured using a manifold absolute pressure (MAP) sensor. An amount of fresh air that may be charged in the cylinder 40 is limited to a flow rate except for the internal EGR amount remaining in the cylinder 40 before the intake air flows into the cylinder 40.

FIG. 7 is a diagram illustrating internal EGR in a case in which valve overlap does not occur. In the case in which valve overlap does not occur, as illustrated in FIG. 7, a flow rate of the remaining exhaust gas remaining in the cylinder 40 at a point in time at which the exhaust valve 30 is closed is calculated as the internal EGR amount.

FIG. 8 is a diagram illustrating internal EGR in a case in which valve overlap occurs. As disclosed in Korean Patent Publication No. 10-0412592, published on Dec. 12, 2003, since an exhaust pressure is generally higher than an intake pressure in a period where valve overlap occurs, a phenomenon that exhaust gas passing through the exhaust valve 30 flows back to the intake valve 20 again occurs, and after the exhaust valve 30 is closed, the corresponding backflow gas is charged into the cylinder 40 again in an intake stroke.

Accordingly, in the case in which the valve overlap occurs, in order to calculate the internal EGR amount, both an amount of remaining gas in the cylinder 40 at the point in time at which the exhaust valve 30 is closed and an amount of backflow gas introduced in the intake stroke need to be considered in the valve overlap period.

SUMMARY

As an existing mechanism for changing valve duration, a continuously variable valve lift (CVVL) technology in which lift of a valve varies with engine RPM (revolutions per minute) has been developed. However, in the CVVL system, the valve duration varies but at the same time, the valve lift is changed, such that a degree of freedom of control deteriorates. Here, the valve duration means a time from opening of the valve to closing of the valve.

In order to solve the problem, a continuously variable valve duration (CVVD) apparatus as disclosed in Korean Patent Laid-Open Publication No. 10-2013-0063819, published on Jun. 17, 2013, has been developed. In the CVVD technology, as illustrated in FIG. 4, valve duration may effectively vary without change in valve lift. Further, it is possible to set optimum valve opening and closing points in time by independently controlling the opening point in time and the closing point in time of the valve.

However, if using the continuously variable valve duration apparatus, as illustrated in FIGS. 5A and 5B, a profile of the valve is changed.

FIG. 5A illustrates a change in a shape of a valve profile in a case in which valve duration is fixed, and valve duration of an intake valve is changed using the continuously variable valve duration apparatus. In FIG. 5A, an x-axis indicates an operation angle of the valve and a y-axis indicates a valve lift amount. In FIG. 5A, a closing point in time of the valve varies ($IC_1$ to $IC_3$) in a state in which an opening point in time (IO) of the intake valve is fixed, by using the continuously variable valve duration apparatus. In this case, a valve overlap period is the same, but valve duration of the intake valve is changed, thus an effective area in which valve overlap occurs is changed.

In an example of FIG. 5B, on the contrary, the valve duration of the intake valve is fixed, and an opening point in time of an exhaust valve is advanced or retarded in a state of fixing a closing point in time (EC) to change the valve duration.

Also in the example of FIG. 5B, a valve overlap period is the same, but the valve duration of the exhaust valve is changed, thus an effective area in which valve overlap occurs is changed.

The change in effective area in which valve overlap occurs means that a flow amount in the valve overlap period is changed. That is, an amount of backflow gas is changed, and as a result, finally, a flow rate of internal EGR is changed.

As illustrated in FIGS. 5A and 5B, if the duration of the intake or exhaust valve is increased, an effective opening area of the valve is decreased even in the same valve overlap period, such that the flow rate of the backflow gas is decreased.

If the phenomenon as described above is not reflected, when valve duration is large, an internal EGR amount is calculated to be larger than its actual value, and as a result, a flow rate of fresh air is calculated to be smaller than its actual value. If the flow rate of the fresh air is calculated to be smaller than its actual value, then less fuel is injected, and output performance of the engine deteriorates. On the contrary, if the valve duration is small, the internal EGR amount is calculated to be smaller than its actual value, and the flow rate of fresh air is calculated to be larger than its actual value. In this case, since a larger amount of fuel relatively to an actual air amount is injected, fuel efficiency may deteriorate.

However, a technology in which when controlling an intake amount of the engine using the continuously variable valve duration apparatus, the intake amount is controlled in consideration of a change in valve duration according to the use of the continuously variable valve duration apparatus has not yet been suggested up to now.

An embodiment of the present disclosure is directed to a control method and apparatus capable of accurately calculating an internal EGR amount in consideration of a change in valve duration according to use of a continuously variable valve duration apparatus.

Other objects and advantages of the present disclosure can be understood by the following description, and become apparent with reference to the embodiments of the present disclosure. Also, it is obvious to those skilled in the art to which the present disclosure pertains that the objects and advantages of the present disclosure can be realized by the means as claimed and combinations thereof.

In accordance with an embodiment of the present disclosure, there is provided a method for calculating an internal exhaust gas recirculation (EGR) amount of an engine including a continuously variable valve duration apparatus (CVVD), in which an internal EGR amount is calculated based on valve duration changed by an operation of the continuously variable valve duration apparatus during valve overlap of an intake valve or an exhaust valve.

The internal EGR amount may be the sum of a residual gas amount in a cylinder of the engine and a backflow gas amount of gas flowing back into the cylinder during valve overlap, and the backflow gas amount may be a value obtained by correcting a basic backflow gas amount determined based on an exhaust pressure, an intake pressure, an exhaust gas temperature, and valve overlap duration in a valve overlap period based on the valve duration changed by the operation of the continuously variable valve duration apparatus.

When correcting the basic backflow gas amount, the basic backflow gas amount may be corrected at a predetermined ratio by using valve profile determined based on a maximum opening point in time (most opening position (MOP)) and a valve closing point in time of the intake valve or the exhaust valve controlled by the continuously variable valve duration apparatus.

When correcting the basic backflow gas amount, the basic backflow gas amount may be corrected at a predetermined ratio by using valve profile determined based on a maximum opening point in time (most opening position (MOP)) and a valve opening point in time of the intake valve or the exhaust valve controlled by the continuously variable valve duration apparatus.

When correcting the basic backflow gas amount, the basic backflow gas amount may be corrected at a predetermined ratio by using valve profile determined based on an opening point in time and a closing point in time of the intake valve or the exhaust valve controlled by the continuously variable valve duration apparatus.

When correcting the basic backflow gas amount, the basic backflow gas amount may be corrected at a predetermined ratio by using valve profile determined based on valve duration and a maximum opening point in time (MOP) of the intake valve or the exhaust valve controlled by the continuously variable valve duration apparatus.

The basic backflow gas amount may be corrected at a predetermined ratio by using valve profile determined as a function of valve duration of the intake valve or the exhaust valve controlled by the continuously variable valve duration apparatus.

An amount of fresh air charged in a cylinder may be determined based on the calculated internal EGR amount, and an intake amount of the engine may be controlled according to the determined amount of fresh air.

The method may include: calculating a residual gas amount in a cylinder of the engine; determining whether the valve overlap occurs; calculating a basic backflow gas amount of gas flowing back to the intake valve in a corresponding valve overlap period when the valve overlap occurs; correcting the basic backflow gas amount based on the valve duration changed by the operation of the continuously variable valve duration apparatus; and calculating the internal EGR amount by adding up the residual gas amount in the cylinder of the engine and the corrected basic backflow gas amount.

The method may further include: calculating the residual gas amount in the cylinder of the engines as the internal EGR amount if it is determined that the valve overlap does not occur.

The method may further include: determining an amount of fresh air charged in the cylinder based on the calculated internal EGR amount, and controlling an intake amount of the engine according to the determined amount of fresh air.

In accordance with another embodiment of the present disclosure, an apparatus for calculating an internal EGR amount of an engine including a continuously variable valve duration apparatus, the apparatus includes: a cylinder residual gas amount calculator configured to calculate a residual gas amount in a cylinder of the engine including the continuously variable valve duration apparatus based on an internal volume and an internal pressure of the cylinder of the engine, and an exhaust gas temperature; a basic backflow gas amount calculator configured to calculate an amount of gas flowing back into the cylinder through an exhaust valve during valve overlap; and an internal EGR amount calculator configured to calculate the internal EGR amount using the cylinder residual gas amount calculated by cylinder residual gas amount calculator and the basic backflow gas amount calculated by the basic backflow gas amount calculator, in which the internal EGR amount calculator calculates the internal EGR amount by correcting the basic backflow gas amount based on valve duration changed by an operation of the continuously variable valve duration apparatus during the valve overlap of an intake valve or the exhaust valve.

The apparatus may further include: an intake amount controller configured to determine an amount of fresh air charged in the cylinder based on the internal EGR amount calculated by the internal EGR amount calculator, and control an intake amount of the engine according to the determined amount of fresh air.

The internal EGR amount calculator may correct the basic backflow gas amount at a predetermined ratio by using valve profile determined based on a maximum opening point in time (MOP) and a valve closing point in time of the intake valve or the exhaust valve controlled by the continuously variable valve duration apparatus.

The internal EGR amount calculator may correct the basic backflow gas amount at a predetermined ratio by using valve profile determined based on a maximum opening point in time (MOP) and a valve opening point in time of the intake valve or the exhaust valve controlled by the continuously variable valve duration apparatus.

The internal EGR amount calculator may correct the basic backflow gas amount at a predetermined ratio by using valve profile determined based on an opening point in time and a closing point in time of the intake valve or the exhaust valve controlled by the continuously variable valve duration apparatus.

The internal EGR amount calculator may correct the basic backflow gas amount at a predetermined ratio by using valve profile determined based on valve duration and a maximum opening point in time (MOP) of the intake valve or the exhaust valve controlled by the continuously variable valve duration apparatus.

The internal EGR amount calculator may correct the basic backflow gas amount at a predetermined ratio by using valve profile determined as a function of valve duration of the intake valve or the exhaust valve controlled by the continuously variable valve duration apparatus.

DESCRIPTION OF SPECIFIC EMBODIMENTS

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the disclosure. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Throughout the specification, unless explicitly described to the contrary, the word "comprise" and variations such as "comprises" or "comprising" will be understood to imply the inclusion of stated elements but not the exclusion of any other elements. In addition, the terms "unit", "-er", "-or", and "module" described in the specification mean units for processing at least one function and operation, and can be implemented by hardware components or software components and combinations thereof.

Further, the control logic of the present disclosure may be embodied as non-transitory computer readable media on a computer readable medium containing executable program instructions executed by a processor, controller or the like. Examples of computer readable media include, but are not limited to, ROM, RAM, compact disc (CD)-ROMs, magnetic tapes, floppy disks, flash drives, smart cards and optical data storage devices. The computer readable medium can also be distributed in network coupled computer systems so that the computer readable media is stored and executed in a distributed fashion, e.g., by a telematics server or a Controller Area Network (CAN).

Hereinafter, exemplary embodiments of the present disclosure will be described with reference to the accompanying drawings.

Figure 1:
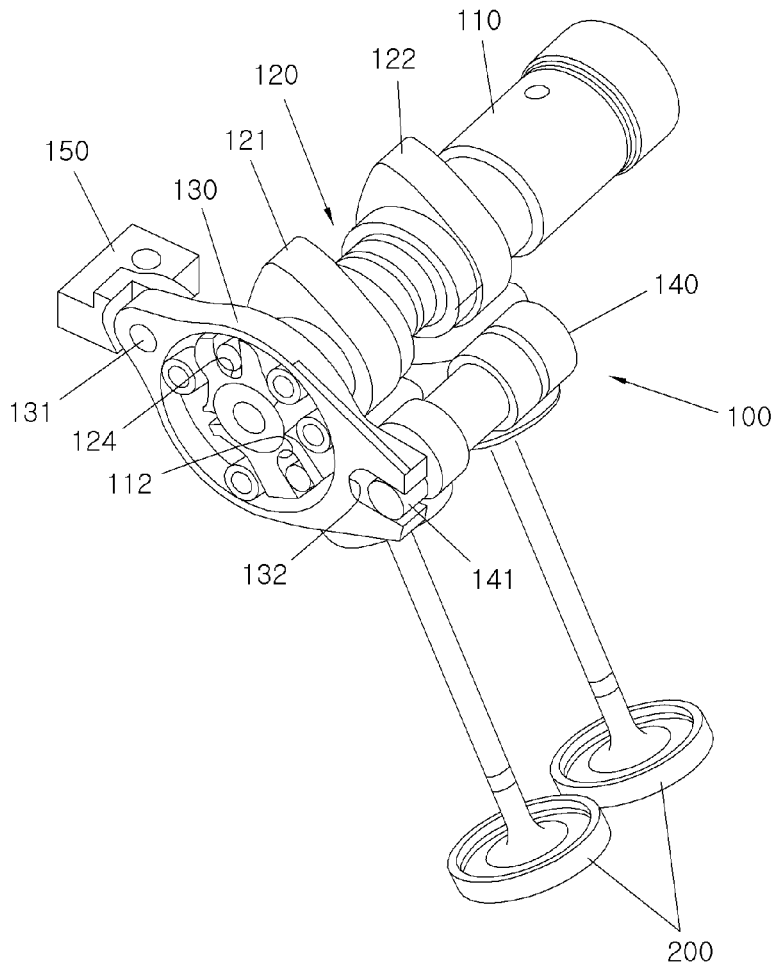
FIG. 1 is a schematic configuration diagram illustrating an example of a continuously variable valve duration apparatus to which a control method and apparatus according to the present disclosure may be applied.

FIG. 1 is a schematic configuration diagram illustrating an example of a continuously variable valve duration apparatus 100 to which a control method according to the present disclosure may be applied.

A continuously variable valve duration apparatus 100 includes a camshaft 110 formed with a camshaft slot 112, and a cam part 120 provided on the camshaft 110 so that a relative phase is variable, including cams 121 and 122 and a cam slot 124, and having a rotation center that coincides with a rotation center of the camshaft 110.

Further, the continuously variable valve duration apparatus 100 includes a roller guide part 130 which is connected with the camshaft slot 112 and the cam slot 124 therein. One end of the roller guide portion 130 is coupled to an engine through a hinge 131 and a bracket 150, and a control slot 132 is formed in the other end of the roller guide portion 130. Further, the continuously variable valve duration apparatus 100 includes a control shaft 140 provided in parallel with the camshaft 110 and having a control pin 141 inserted into the control slot 132 and formed eccentrically at the center of the control shaft 140.

A rotation center of the roller guide part 130 is in parallel with the rotation center of the camshaft 110, and may be moved using an actuator controller by a controller (not illustrated), a motor, or the like. By generating difference between the rotation center of the roller guide part 130 and the rotation center of the camshaft 110, a relative phase angle of the camshaft slot 112 and the cam slot 124 may vary, such that a relative rotation speed of the camshaft 110 and the cam 120 may vary. Accordingly, valve duration which is duration between an opening time and a closing time of valve lift may vary.

Further, the continuously variable valve duration apparatus 100 may vary the valve duration by fixing a valve opening point in time or a valve closing point in time depending on a position design of the hinge 131 and changing the other point in time, and may also vary the valve duration by fixing a maximum opening point in time (most opening position (MOP)), and changing the valve opening point in time or the valve closing point in time.

The continuously variable valve duration apparatus 100 illustrated in FIG. 1 is merely an example of a continuously variable valve duration apparatus to which a control method according to an embodiment of the present disclosure may be applied, and the continuously variable valve duration apparatus to which the control method according to the present disclosure may be applied is not limited to have the above structure illustrated in FIG. 1.

Figure 2:
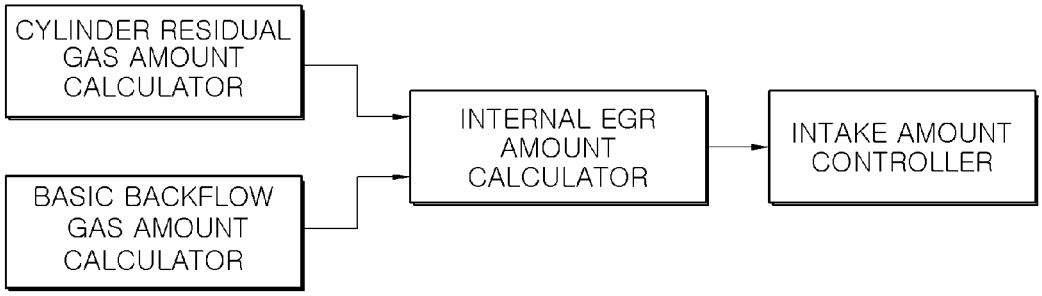
FIG. 2 is a block diagram illustrating a configuration of an apparatus for calculating an internal EGR amount of an engine including a continuously variable valve duration apparatus according to the present disclosure.

FIG. 2 is a block diagram illustrating a configuration of an apparatus for calculating an internal EGR amount of an engine including a continuously variable valve duration apparatus according to the present disclosure.

The apparatus for calculating an internal EGR amount according to an embodiment of the present disclosure includes a cylinder residual gas amount calculator, a basic backflow gas amount calculator, and an internal EGR amount calculator.

The cylinder residual gas amount calculator calculates an amount ($V_{RESIDUAL}$) of residual gas remaining in a cylinder of the engine at the valve opening point in time of the intake valve 20 based on an internal volume and an internal pressure of the cylinder of the engine including the continuously variable valve duration apparatus, an exhaust gas temperature, and the like. At this time, the internal volume of the cylinder means a volume of a combustion chamber in the cylinder 40 at the opening point in time of the intake valve 20. Further, the internal pressure of the cylinder 40 may be calculated using a pressure of a surge tank and a pressure of the exhaust gas that are measured by a manifold absolute pressure (MAP) sensor of the intake system. The exhaust gas temperature may be measured using a temperature sensor installed in the exhaust system.

The cylinder residual gas amount calculator calculates a residual gas amount using a predetermined map that defines values of the internal volume and the internal pressure of the cylinder and the exhaust gas temperature, and a relationship between the values and the residual gas amount in the cylinder. In a case in which valve overlap does not occur, since backflow gas does not exist, the residual gas amount of the cylinder 40 is set as the internal EGR amount as it is.

The basic backflow gas amount calculator calculates an amount of exhaust gas flowing back to the intake valve when the valve overlap occurs. The backflow of the exhaust gas occurring during valve overlap occurs by difference between a pressure of the intake side and a pressure of the exhaust side. Further, a behavior of gas at the time of backflow is changed depending on the exhaust gas temperature and valve overlap duration for a predetermined operation angle.

Therefore, the basic backflow gas amount calculator may calculate a total amount ($V_{BACK}$) of the exhaust gas flowing back to the intake valve by inputting measurement values of the pressure of the intake side and the pressure of the exhaust side and the valve overlap duration, to a predetermined map that defines a relationship between the above values and the amount of backflow gas.

The internal EGR amount calculator calculates a final internal EGR amount ($V_{TOTAL}$) using the calculated results of the cylinder residual gas amount calculator and the basic backflow gas amount calculator.

Basically, the final internal EGR amount ($V_{TOTAL}$) is the sum of the cylinder residual gas amount ($V_{RESIDUAL}$) remaining in the cylinder of the engine at the valve closing point in time and the basic backflow gas amount ($V_{BACK}$). Meanwhile, as described above, in the case in which the valve overlap does not occur, the exhaust gas backflow phenomenon does not exist. Therefore, the cylinder residual gas amount ($V_{RESIDUAL}$) is set as the final internal EGR amount ($V_{TOTAL}$).

Figure 5A:
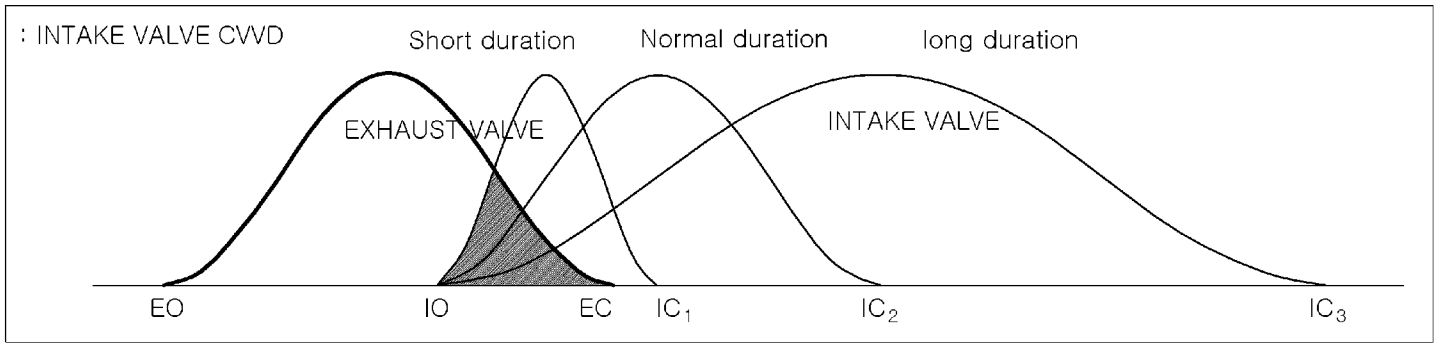
FIGS. 5A and 5B are diagrams illustrating a change in a valve profile when a duration of an intake valve and a duration of an exhaust valve are changed using a continuously variable valve duration apparatus during valve overlap.
Figure 5B:
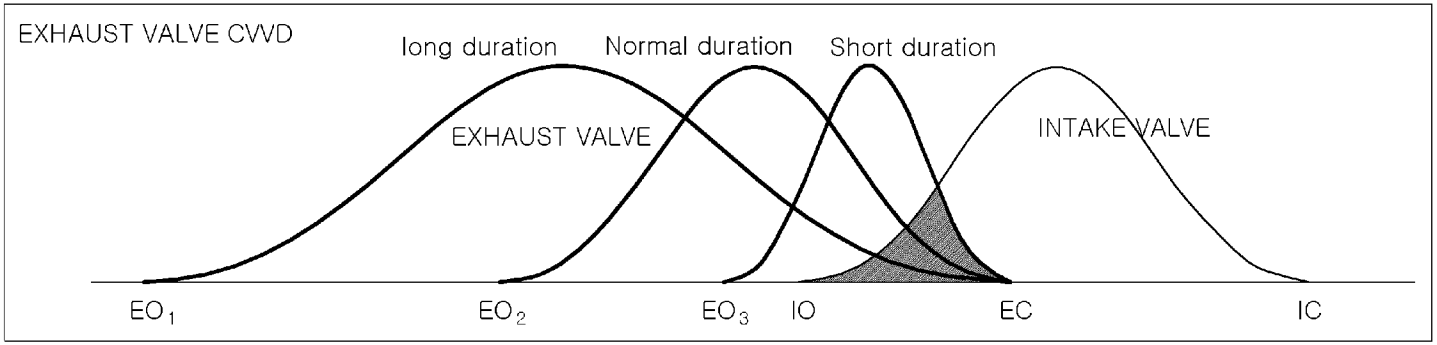

However, as illustrated in FIGS. 5A and 5B, at the time of operation of the continuously variable valve duration apparatus 100, valve profile of the intake valve 20 (FIG. 5A) or the exhaust valve 30 (FIG. 5B) that is an object of control is changed. In particular, the valve profile represents a change in a valve lift amount according to an operation angle of the valve, and an internal area of the valve profile represents an effective opening area of the corresponding valve.

In FIG. 5A, it is assumed that valve duration ($I_{STANDARD}$) of the intake valve 20 in a case in which a control of valve duration by the continuously variable valve duration apparatus 100 is not performed is from an opening point in time (IO) to a closing point in time ($IC_2$) of the intake valve. If the closing point in time is increased from $IC_2$ to $IC_3$ by the continuously variable valve duration apparatus 100 in a state in which the opening point in time (IO) of the intake valve 20 is fixed, a maximum valve lift amount is maintained as it is and the valve duration is increased, such that the valve profile is changed.

Accordingly, even when the valve overlap occurs in the same period (IO to EC), an area (effective opening area) of a portion in which the valve profiles of the intake valve 20 and the exhaust valve 30 overlap each other during the valve overlap is changed. As a result, a flow rate of the backflow gas during the valve overlap is also changed. Therefore, the internal EGR amount calculator corrects the basic backflow gas amount calculated by the basic backflow gas amount calculator based on the valve duration changed by the operation of the continuously variable valve duration apparatus 100.

Preferably, to this end, the internal EGR amount calculator calculates a correction factor from a change in an effective opening area when the valve duration is changed by the operation of the continuously variable valve duration apparatus 100, and corrects the basic backflow gas amount ($V_{BACK}$) by multiplying the basic backflow gas amount ($V_{BACK}$) by the correction factor.

In the example of FIG. 5A described above, a basic valve profile (IO→$IC_2$) of the intake valve 20 in the case in which the valve control by the continuously variable valve duration apparatus 100 is not performed is a predetermined value according to a specification of the valve applied in a vehicle and stored in the internal EGR amount calculator. Accordingly, in the case in which the valve control by the continuously variable valve duration apparatus 100 is not performed, an area (A1) in which the valve profile (IO→$IC_2$) of the intake valve 20 and the profile (EO→EC) of the exhaust valve 30 overlap each other during the valve overlap may be determined by the opening point in time (IO) of the intake valve and the closing point in time (EC) of the exhaust valve.

Meanwhile, the valve profile (IO→$IC_3$) of the intake valve in a case in which the valve control by the continuously variable valve duration apparatus 100 is performed is a value obtained by changing the valve profile (IO→$IC_2$) at a predetermined ratio according to the change in the valve duration. Once the changed valve profile (IO→$IC_3$) is obtained, an area (A2) in which the valve profile of the intake valve 20 and the profile (EO→EC) of the exhaust valve 30 overlap each other in the case in which the valve control by the continuously variable valve duration apparatus 100 is performed may be obtained using the opening point in time (IO) of the intake valve and the closing point in time (EC) of the exhaust valve.

As described above, if the valve duration is increased, the effective opening area in the same valve overlap period is decreased, and on the contrary, if the valve duration is decreased, the effective opening area is increased in the same valve overlap period. Accordingly, in the case, as the correction factor for reflecting this, a ratio (A2/A1) of the area (A1) in which the valve profile (IO→$IC_2$) of the intake valve 20 and the profile (EO→EC) of the exhaust valve 30 overlap each other in which the valve control by the continuously variable valve duration apparatus 100 is not performed and the area (A2) in which the valve profile of the intake valve 20 and the profile (EO→EC) of the exhaust valve 30 overlap each other in which the valve control by the continuously variable valve duration apparatus 100 is performed may be calculated.

As described above, the valve profile (IO→$IC_2$) at the time of the valve control by the continuously variable valve duration apparatus 100 is determined by the change in the valve duration.

Therefore, preferably, the maximum opening point in time (MOP) and the valve closing point in time ($IC_2$) of the valve controlled by the continuously variable valve duration apparatus 100 may be obtained and the valve profile (IO→$IC_2$) at the time of the valve control by the continuously variable valve duration apparatus 100 may be obtained as a predetermined function for the maximum opening point in time (MOP) and the valve closing point in time ($IC_2$).

Further, in another preferred example, the maximum opening point in time (MOP) and the valve opening point in time (IO) of the valve controlled by the continuously variable valve duration apparatus 100 may be obtained and the valve profile (IO→$IC_2$) may be obtained as a predetermined function for the maximum opening point in time (MOP) and the valve opening point in time (IO).

Further, in another preferred example, the opening point in time (IO) and the closing point in time ($IC_2$) of the valve controlled by the continuously variable valve duration apparatus 100 may be obtained and the valve profile (IO→$IC_2$) may be obtained as a predetermined function for the opening point in time (IO) and the closing point in time ($IC_2$) of the valve.

Alternatively, the valve duration and the maximum opening point in time (MOP) of the valve controlled by the continuously variable valve duration apparatus 100 may be obtained and the valve profile (IO→$IC_2$) may be obtained therefrom.

Alternatively, the valve profile (IO→$IC_2$) is defined as a function specified for the valve duration of the valve controlled by the continuously variable valve duration apparatus 100 and the valve duration value is obtained, and the valve profile (IO→$IC_2$) may be obtained therefrom.

More preferably, the apparatus for calculating an internal EGR amount according to the present disclosure may further include an intake amount controller determining an amount of fresh air charged in the cylinder 40 based on the internal EGR amount calculated by the internal EGR amount calculator and controlling an intake amount of the engine according to the determined amount of fresh air.

The intake amount controller controls a throttle valve 10 or the like to perform a control of decreasing the amount of fresh air when the internal EGR amount is increased, and increasing the amount of fresh air when the internal EGR amount is decreased. By doing so, it is possible to optimally control the intake amount to suppress generation of the exhaust gas and increase efficiency of the engine.

Figure 3:
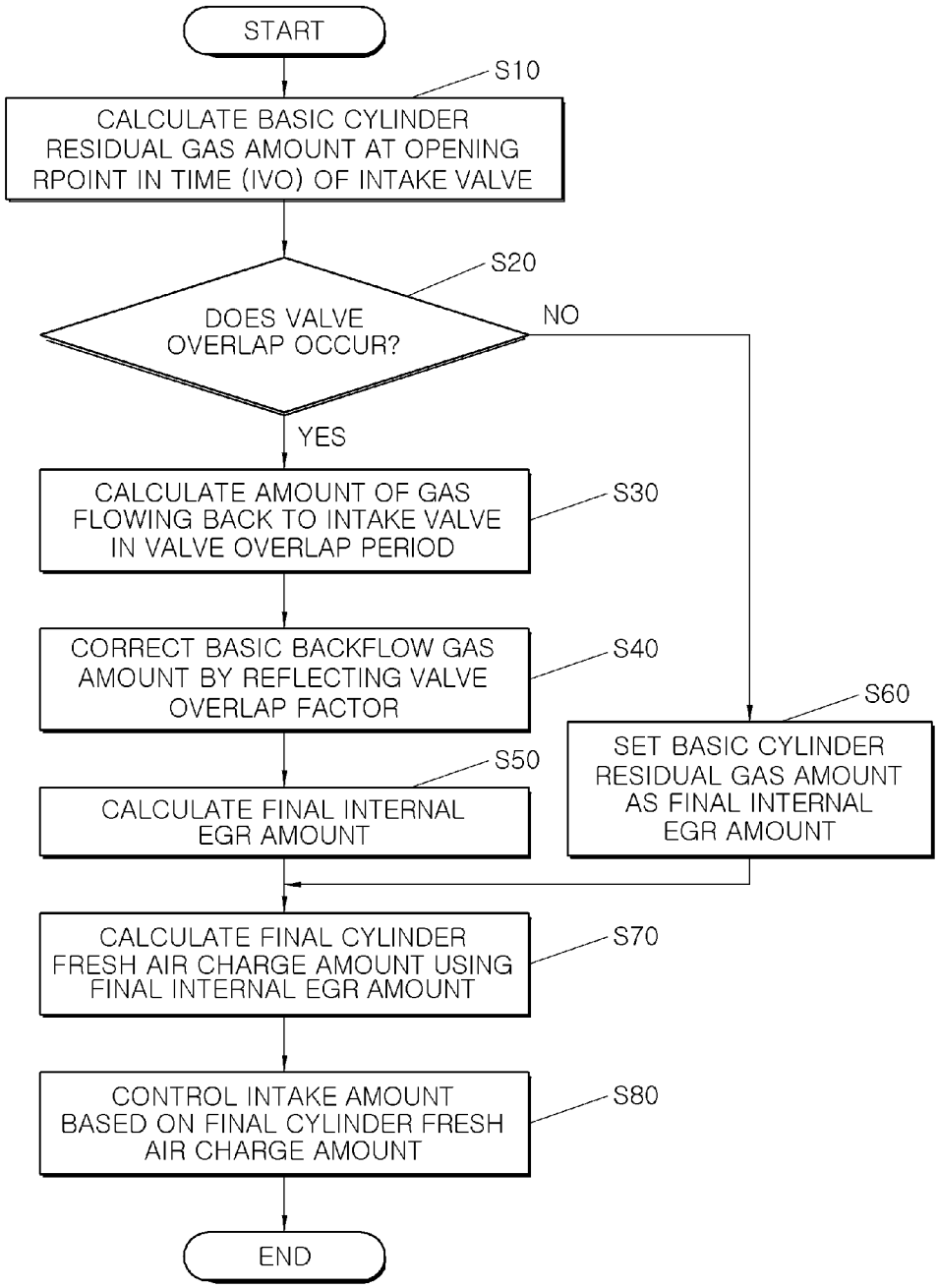
FIG. 3 is a flowchart illustrating a method for calculating an internal EGR amount of an engine including a continuously variable valve duration apparatus according to the present disclosure.
Figure 4:
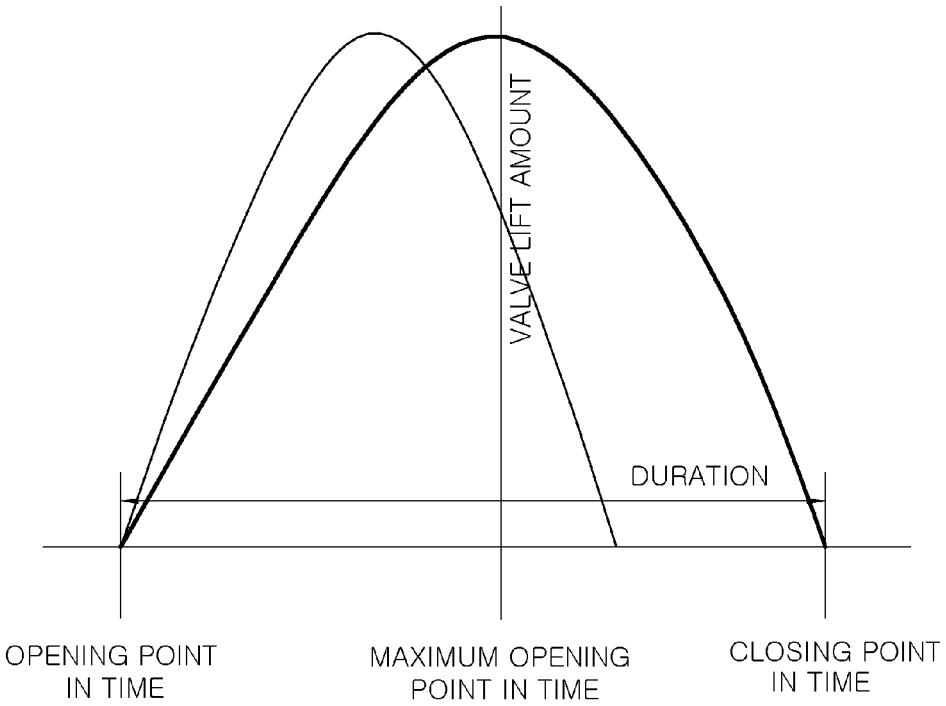
FIG. 4 is a diagram illustrating valve duration changed by a continuously variable valve duration apparatus and a change in a valve profile at this time.

FIG. 3 is a flowchart illustrating a method for calculating an internal EGR amount of an engine including a continuously variable valve duration apparatus according to the present disclosure.

Referring to FIG. 3, the cylinder residual gas amount calculator calculates a basic cylinder residual gas amount ($V_{RESIDUAL}$) at an opening point in time (IVO) of the intake valve 20 (S10). As described above, the cylinder residual gas amount calculator may calculate the residual gas amount of the cylinder 40 from an internal volume and an internal pressure of the cylinder and an exhaust gas temperature.

Next, the basic backflow gas amount calculator determines whether valve overlap occurs in order to calculate a basic backflow gas amount (S20). The valve overlap means a state in which as the opening point in time (IVO) of the intake valve 20 exists before a closing point in time (EVC) of the exhaust valve 30, both of the exhaust valve 30 and the intake valve 20 are open. Therefore, whether the valve overlap occurs may be checked by using the closing point in time (EVC) of the exhaust valve 30 and the opening point in time (IVO) of the intake valve 20.

As described above, in the case in which the valve overlap does not occur, the exhaust gas backflow phenomenon does not exist. Therefore, the internal EGR amount calculator determines the basic cylinder residual gas amount ($V_{RESIDUAL}$) calculated in step S10 as a final internal EGR amount ($V_{TOTAL}$) (S60).

If it is determined that the valve overlap occurs, in order to determine the final internal EGR amount, the basic backflow gas amount calculator calculates a basic amount ($V_{BACK}$) of backflow gas flowing back to the intake valve in the valve overlap period (S30). As described above, the basic backflow gas amount calculator may calculate the basic backflow gas amount ($V_{BACK}$) from an exhaust pressure, an intake pressure, an exhaust gas temperature, and valve overlap duration. The basic backflow gas amount ($V_{BACK}$) is a value related to basic valve profile in the case in which the valve control by the continuously variable valve duration apparatus 100 is not performed.

Next, the internal EGR amount calculator corrects the basic backflow gas amount ($V_{BACK}$) based on the valve duration changed by the operation of the continuously variable valve duration apparatus 100. As described above, the internal EGR amount calculator determines a correction factor based on the valve profile according to the change in the valve duration, and corrects the basic backflow gas amount ($V_{BACK}$) by multiplying the basic backflow gas amount ($V_{BACK}$) by the correction factor. The correction process of the basic backflow gas amount ($V_{BACK}$) performed by the internal EGR amount calculator is already described with reference to FIG. 2 in detail, detailed description therefor will be omitted.

Next, the internal EGR amount calculator calculates the final internal EGR amount by adding up a corrected basic backflow gas amount ($V_{BACK}'$) and the basic cylinder residual gas amount ($V_{RESIDUAL}$) (S50).

Further, the intake amount controller calculates a final cylinder fresh air charge amount based on the final internal EGR amount calculated by the internal EGR amount calculator (S70). As the final cylinder fresh air charge amount, a difference between an intake amount corresponding to the best air-fuel ratio at which efficiency of the engine may be maximized and generation of harmful exhaust gas may be suppressed and the calculated final internal EGR amount may be obtained.

When the final cylinder fresh air charge amount is determined, the intake amount controller controls an intake amount by controlling the throttle valve 10 or the like of the intake system so that fresh air corresponding to the final cylinder fresh air charge amount is introduced (S80).

Figure 6A:
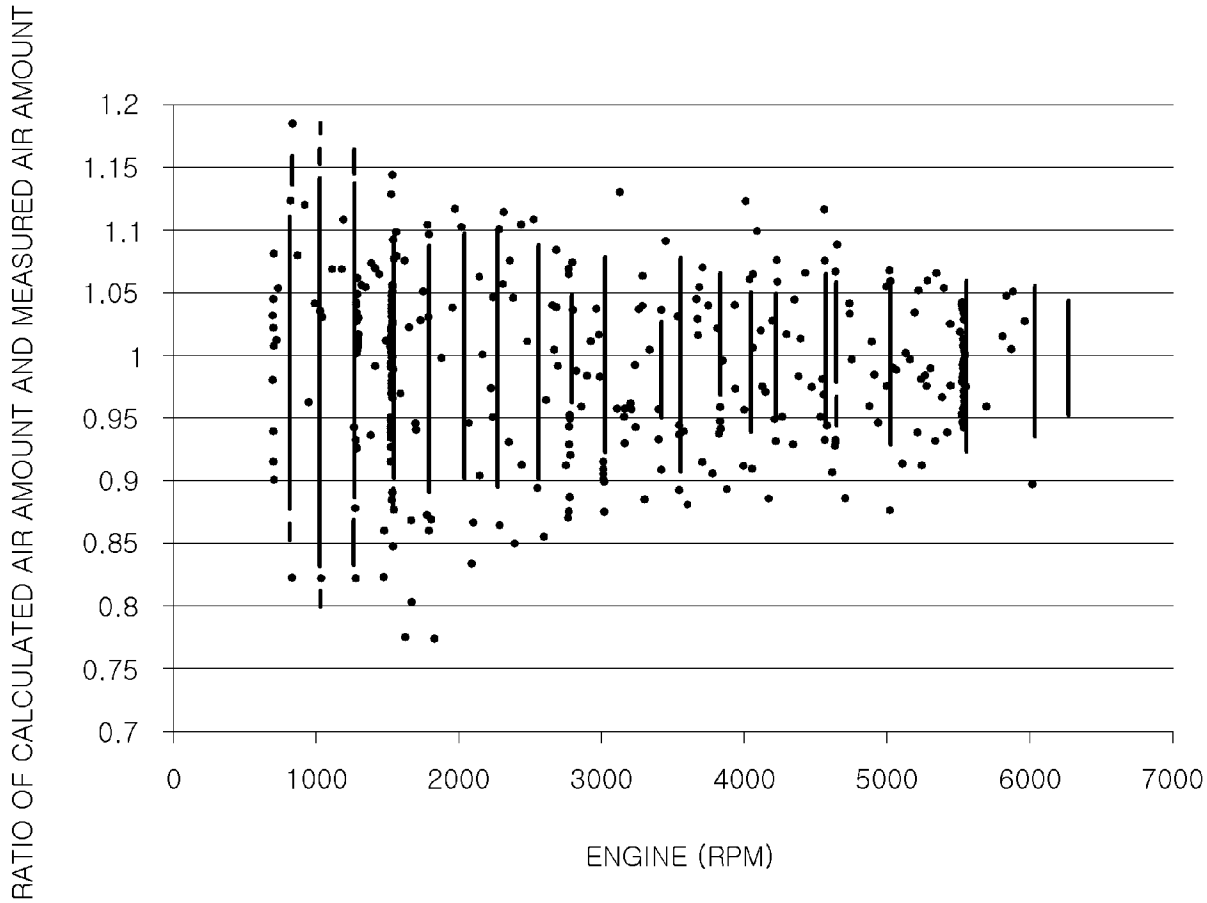
FIG. 6A is a diagram illustrating a change in a ratio of a calculated air amount and a measured air amount according to engine RPM in a comparative example.
Figure 6B:
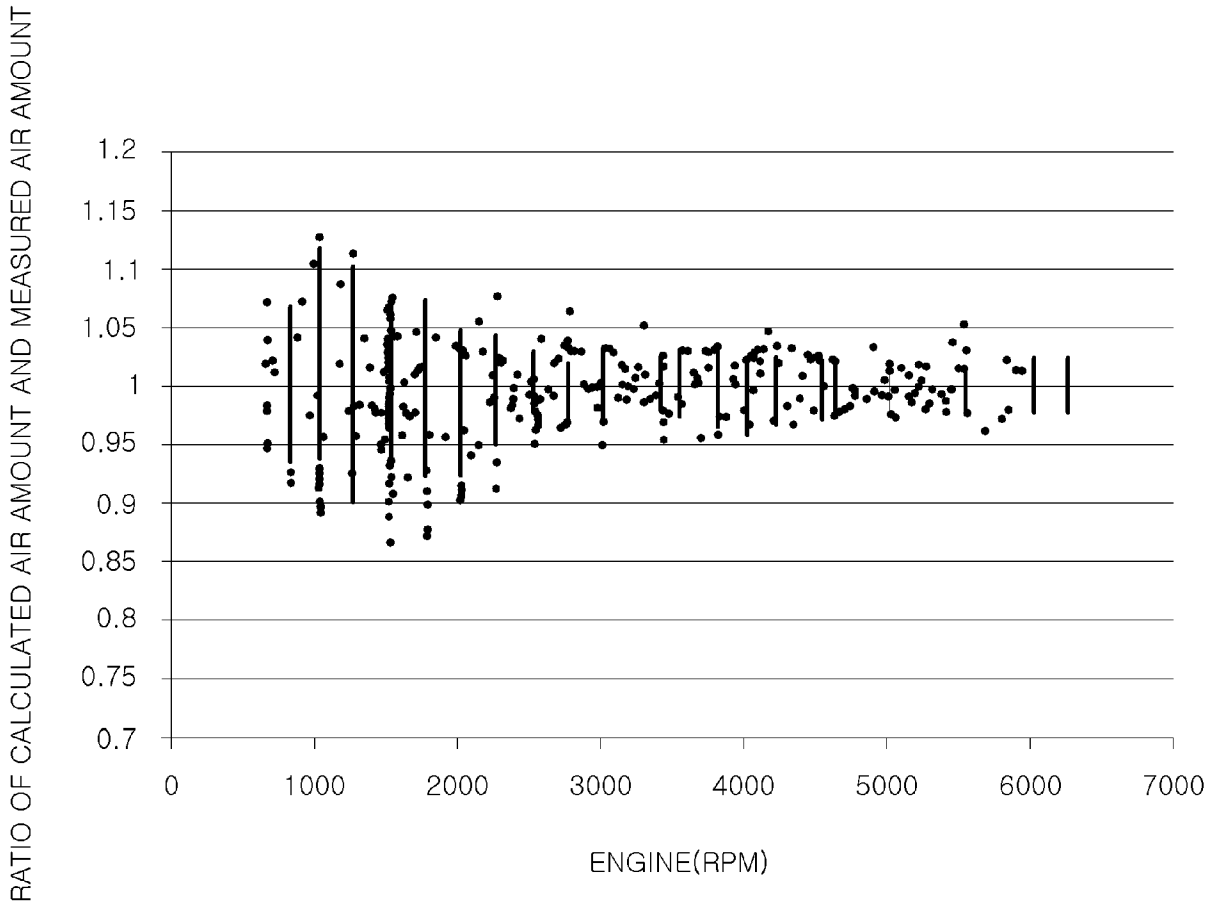
FIG. 6B is a diagram illustrating a change in a ratio of a calculated air amount and a measured air amount according to engine RPM in an example according to the present disclosure.
Figure 7:
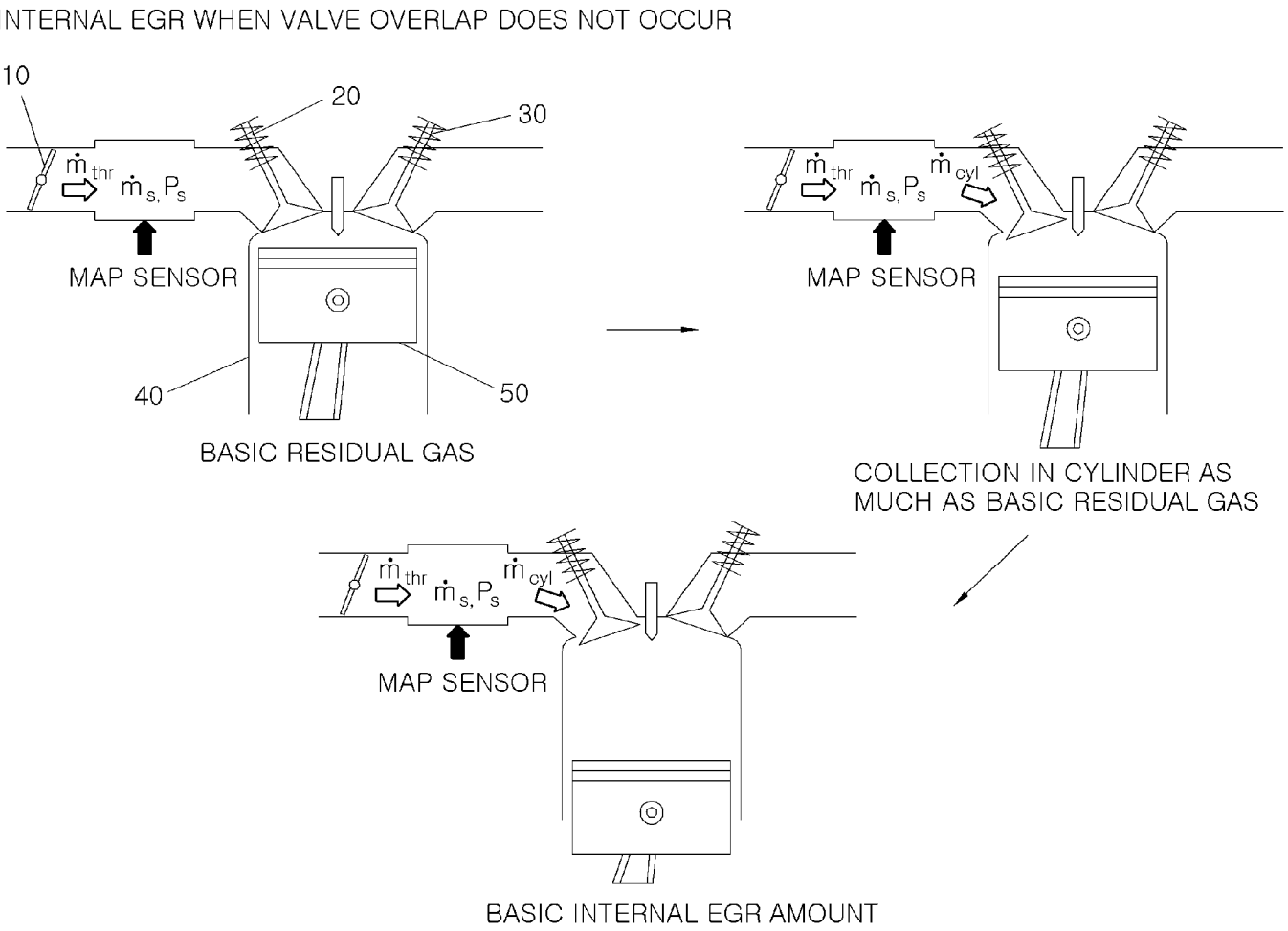
FIG. 7 is a diagram illustrating internal EGR of an intake system in a case in which valve overlap does not occur.
Figure 8:
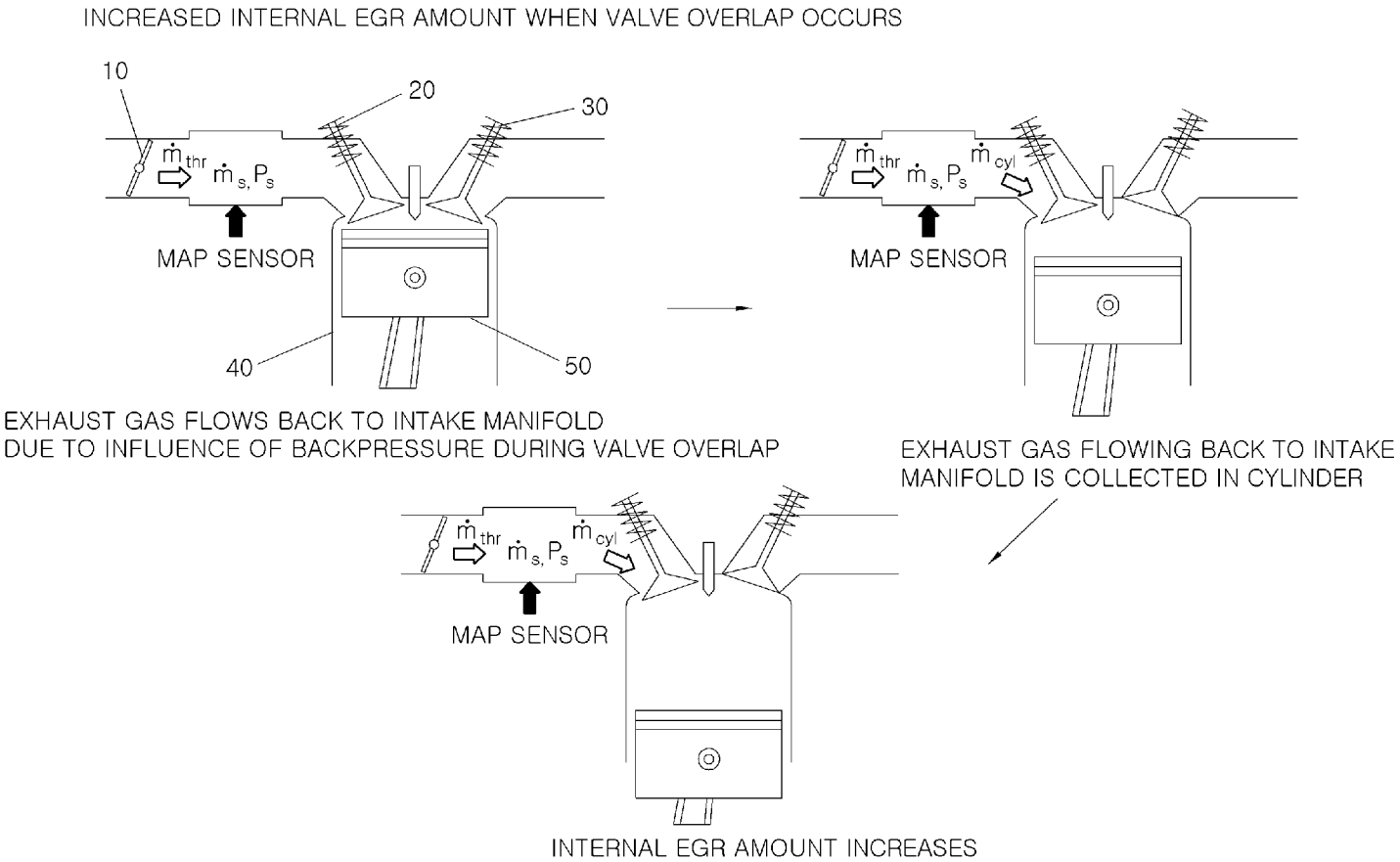
FIG. 8 is a diagram illustrating internal EGR of an intake system in a case in which valve overlap occurs.

FIGS. 6A and 6B are diagrams illustrating a ratio of a calculated air amount (cylinder charge amount) and a measured air amount according to engine RPM. FIG. 6A illustrates a result of a comparative example in which the method for calculating an internal EGR amount according to the present disclosure is not applied, and FIG. 6B is a result of an example in which the method for calculating an internal EGR amount according to the present disclosure is applied.

In the case of the comparative example in which since the method for calculating an internal EGR amount according to the present disclosure was not applied, a cylinder charge amount was calculated by calculating the internal EGR amount without considering influence by the change in the valve duration, a standard deviation of the calculated air amount/measured air amount was about 3.67%. On the contrary, in the case of the example in which the method for calculating an internal EGR amount according to the present disclosure was applied to correct the internal EGR amount, the standard deviation of the calculated air amount/measured air amount was decreased by nearly half, that is, the standard deviation was about 1.84%.

As such, according to the control method and apparatus according to the present disclosure, it is possible to accurately calculate the internal EGR amount when the valve duration is changed by the continuously variable valve duration apparatus, such that an accurate required amount of air may be supplied to the engine.

Therefore, according to the present disclosure, excessive fuel supply may be suppressed such that fuel efficiency may be improved. Further, it is possible to suppress a supply of fuel that is less than an actually required fuel amount to prevent decrease in output of the engine and suppress generation of harmful exhaust gas.

What is claimed is:

1. A method for calculating an internal exhaust gas recirculation (EGR) amount of an engine including a continuously variable valve duration apparatus (CVVD), comprising:

calculating an internal EGR amount, by an internal EGR amount calculator, based on valve duration changed by operation of the continuously variable valve duration apparatus during valve overlap of an intake valve or an exhaust valve, wherein the internal EGR amount is a sum of a residual gas amount in a cylinder of the engine and a backflow gas amount of gas flowing back into the cylinder during valve overlap, and wherein the backflow gas amount is a value obtained by correcting a basic backflow gas amount determined based on an exhaust pressure, an intake pressure, an exhaust gas temperature, and valve overlap duration in a valve overlap period based on the valve duration changed by the operation of the continuously variable valve duration apparatus.

2. The method of claim 1, wherein when correcting the basic backflow gas amount, the basic backflow gas amount is corrected at a predetermined ratio by using valve profile determined based on a maximum opening point in time (most opening position (MOP)) and a valve closing point in time of the intake valve or the exhaust valve controlled by the continuously variable valve duration apparatus.

3. The method of claim 1, wherein when correcting the basic backflow gas amount, the basic backflow gas amount is corrected at a predetermined ratio by using valve profile determined based on a maximum opening point in time (MOP) and a valve opening point in time of the intake valve or the exhaust valve controlled by the continuously variable valve duration apparatus.

4. The method of claim 1, wherein when correcting the basic backflow gas amount, the basic backflow gas amount is corrected at a predetermined ratio by using valve profile determined based on an opening point in time and a closing point in time of the intake valve or the exhaust valve controlled by the continuously variable valve duration apparatus.

5. The method of claim 1, wherein when correcting the basic backflow gas amount, the basic backflow gas amount is corrected at a predetermined ratio by using valve profile determined based on valve duration and a maximum opening point in time (MOP) of the intake valve or the exhaust valve controlled by the continuously variable valve duration apparatus.

6. The method of claim 1, wherein the basic backflow gas amount is corrected at a predetermined ratio by using valve profile determined as a function of valve duration of the intake valve or the exhaust valve controlled by the continuously variable valve duration apparatus.

7. The method of claim 1, wherein an amount of fresh air charged in a cylinder is determined based on the calculated internal EGR amount, and an intake amount of the engine is controlled according to the determined amount of fresh air.

8. The method of claim 1, comprising:

calculating a residual gas amount in a cylinder of the engine;

determining whether the valve overlap occurs;

calculating a basic backflow gas amount of gas flowing back to the intake valve in a corresponding valve overlap period when the valve overlap occurs;

correcting the basic backflow gas amount based on the valve duration changed by the operation of the continuously variable valve duration apparatus; and calculating the internal EGR amount by adding up the residual gas amount in the cylinder of the engine and the corrected basic backflow gas amount.

9. The method of claim 8, further comprising:

calculating the residual gas amount in the cylinder of the engines as the internal EGR amount if it is determined that the valve overlap does not occur.

10. The method of claim 8, further comprising:

determining an amount of fresh air charged in the cylinder based on the calculated internal EGR amount, and controlling an intake amount of the engine according to the determined amount of fresh air.

11. An apparatus for calculating an internal EGR amount of an engine including a continuously variable valve duration apparatus, the apparatus comprising:

a cylinder residual gas amount calculator configured to calculate a residual gas amount in a cylinder of the engine including the continuously variable valve duration apparatus based on an internal volume and an internal pressure of the cylinder of the engine, and an exhaust gas temperature;

a basic backflow gas amount calculator configured to calculate an amount of gas flowing back into the cylinder through an exhaust valve during valve overlap based on exhaust pressure, an intake pressure, an exhaust gas temperature, and valve overlap duration in a valve overlap period; and an internal EGR amount calculator configured to calculate the internal EGR amount using the cylinder residual gas amount calculated by cylinder residual gas amount calculator and the basic backflow gas amount calculated by the basic backflow gas amount calculator, wherein the internal EGR amount calculator calculates the internal EGR amount by correcting the basic backflow gas amount based on valve duration changed by an operation of the continuously variable valve duration apparatus during the valve overlap of an intake valve or the exhaust valve.

12. The apparatus of claim 11, further comprising:

an intake amount controller configured to determine an amount of fresh air charged in the cylinder based on the internal EGR amount calculated by the internal EGR amount calculator, and control an intake amount of the engine according to the determined amount of fresh air.

13. The apparatus of claim 11, wherein the internal EGR amount calculator corrects the basic backflow gas amount at a predetermined ratio by using valve profile determined based on a maximum opening point in time (MOP) and a valve closing point in time of the intake valve or the exhaust valve controlled by the continuously variable valve duration apparatus.

14. The apparatus of claim 11, wherein the internal EGR amount calculator corrects the basic backflow gas amount at a predetermined ratio by using valve profile determined based on a maximum opening point in time (MOP) and a valve opening point in time of the intake valve or the exhaust valve controlled by the continuously variable valve duration apparatus.

15. The apparatus of claim 11, wherein the internal EGR amount calculator corrects the basic backflow gas amount at a predetermined ratio by using valve profile determined based on an opening point in time and a closing point in time of the intake valve or the exhaust valve controlled by the continuously variable valve duration apparatus.

16. The apparatus of claim 11, wherein the internal EGR amount calculator corrects the basic backflow gas amount at a predetermined ratio by using valve profile determined based on valve duration and a maximum opening point in time (MOP) of the intake valve or the exhaust valve controlled by the continuously variable valve duration apparatus.

17. The apparatus of claim 11, wherein the internal EGR amount calculator corrects the basic backflow gas amount at a predetermined ratio by using valve profile determined as a function of valve duration of the intake valve or the exhaust valve controlled by the continuously variable valve duration apparatus.

* * * * *